United States Patent [19]

Ogawa et al.

[11] 4,374,433

[45] Feb. 15, 1983

[54] STEREO PICKUP WITH PRINTED CIRCUIT COILS MOUNTED IN A LINEAR FIELD

[75] Inventors: Hiroshi Ogawa, Yokohama; Kazuhiro Sato; Norio Shibata, both of Sagamihara; Katsuhiko Oguri, Fujisawa; Masayoshi Utida, Yokohama; Tsuyoshi Ono, Yamato, all of Japan

[73] Assignee: Victor Company of Japan, Ltd., Kanagawa, Japan

[21] Appl. No.: 122,261

[22] Filed: Feb. 19, 1980

Related U.S. Application Data

[63] Continuation of Ser. No. 923,943, Jul. 11, 1978, abandoned.

[30] Foreign Application Priority Data

| | | | |
|---|---|---|---|
| Jul. 13, 1977 | [JP] | Japan | 52-92817[U] |
| Jul. 13, 1977 | [JP] | Japan | 52-92818[U] |
| Jul. 13, 1977 | [JP] | Japan | 52-92820[U] |
| Jul. 13, 1977 | [JP] | Japan | 52-92821[U] |
| Jul. 25, 1977 | [JP] | Japan | 52-99240[U] |

[51] Int. Cl.[3] ..... H04R 9/16; H04R 9/04

[52] U.S. Cl. ..... 369/136; 369/147

[58] Field of Search ..... 179/100.41 K, 100.41 D, 179/100.41 M, 100.41 Z; 360/123; 274/37; 369/136, 139, 147

[56] References Cited

U.S. PATENT DOCUMENTS

| | | | |
|---|---|---|---|
| 2,034,872 | 3/1936 | Keller | 179/100.41 D |
| 3,207,857 | 9/1965 | Poutot | 179/100.41 K |
| 3,360,616 | 12/1967 | Shiga et al. | 179/100.41 K |
| 3,618,124 | 11/1971 | Dreisbach | 179/100.41 D |
| 3,648,264 | 3/1972 | Gruczeluk et al. | 360/123 |
| 3,679,843 | 7/1972 | Cho | 179/100.41 K |
| 3,903,594 | 9/1975 | Koneval | 179/100.41 D |
| 4,093,833 | 6/1978 | Tsukamoto | 179/100.41 D |
| 4,124,783 | 11/1978 | Nemoto | 179/100.41 D |

FOREIGN PATENT DOCUMENTS

| | | | |
|---|---|---|---|
| 1135675 | 8/1962 | Fed. Rep. of Germany | 179/100.41 K |
| 928077 | 6/1963 | United Kingdom | 179/100.41 K |
| 939983 | 10/1963 | United Kingdom | 179/100.41 K |

*Primary Examiner*—Raymond F. Cardillo, Jr.

*Attorney, Agent, or Firm*—Michael N. Meller; Anthony H. Handal

[57] ABSTRACT

A moving-coil type stereo pickup cartridge comprises a vibration mechanism, including a stylus for tracing the groove of a sound track on a record disc, at least one coil plate provided in the vibration system and adapted to vibrate in response to vibrations of the stylus, and a structure for forming a magnetic field for the coil plate. The coil plate comprises a thin insulative substrate and a pair of left and right coils substantially symmetric with respect to a center line and formed by an electrically conductive thin film placed in a spirally wound pattern on at least one surface of the substrate. The magnetic field-forming construction comprises a permanent magnet and a pair of yokes adapted to clamp the permanent magnet. The pair of yokes have confronting surfaces for defining a gap in which the coil plate is interposed and a recessed substantially reverse V-shaped notch or cutout. The notch is defined by edge parts or facets. The configuration of the edge parts is such that the contour lines of the density of the leakage magnetic flux at least within the space confronting the coils and in the notch extend substantially at angles of plus and minus 45° to the center line.

8 Claims, 19 Drawing Figures

STEREO PICKUP WITH PRINTED CIRCUIT COILS MOUNTED IN A LINEAR FIELD

This is a continuation of application Ser. No. 923,943, filed July 11, 1978, now abandoned.

BACKGROUND OF THE INVENTION

The present invention relates generally to moving-coil type stereo pickup cartridges, and more particularly to a moving-coil type stereo pickup cartridge in which a vortex-shaped pattern coil, made of an electrically conductive film formed onto an electrically insulating plate, is provided in a vibrating system, and which is also contructed so as not to generate crosstalk.

In general, among the moving-coil type stereo pickup cartridges known heretofore, one type has a vibration system with structure wherein a square or cross-shaped core, around which coil wire is wound, is fixed to the rear end of a cantilever. In another known pickup cartridge of this type, two armature links are provided on a cantilever and coils are provided by winding coil wire respectively around the ends of these links.

In each of these known pickup cartridges, however, the moving-coil assembly which is fixed to the cantilever and which comprises the coil winding and the core or the coil windings and the armature links, has a large mass. Therefore, the equivalent mass of the vibration system is large, and the characteristics, particularly in the high-frequency range, are poor, and signal pickup with good characteristics over a wide band cannot be achieved. If, in order to reduce the mass, the number of winding turns of the coils is decreased, the output will drop. Consequently, it has not been possible by means of the known moving-coil type pickup cartridges to accomplish good signal pickup reproduction with high output, good signal-to-noise ratio, and flat characteristics up to the high-frequency range over a wide band.

Another difficulty encountered in the prior art has been that, since a magnetic material such as iron or permalloy has been used for the core or coil winding frame, the magnetostriction due to hysteresis and magnetic saturation is large. Still another difficulty has been that, since the coil assembly comprises coil wire wound around a winding frame, the thickness and volume of the coil structure are large. For this reason, the gap between the yoke and the pole piece in which the coil structure is interposed must be made large, whereby the magnetic conversion efficiency is poor. A further problem has been that the work of winding the coil wire around the winding frame has been laborious. Particularly, in order to obtain a high value of the above-mentioned magnetic conversion efficiency, it is necessary to reduce the thickness and volume of the coil structure, thereby to decrease the above-mentioned gap. For this purpose, a very fine wire (e.g., 10 microns in diameter) must be used for the coil wire, and this causes difficulties in the coil winding work, risk of wire breakage, and lowering of work efficiency.

Another known stereo pickup cartridge of the moving-coil type is shown in British Patent No. 939,983. This known pickup cartridge has a pair of coils, each of which is of the same size and is wound so as to be D-shaped, the turns of each coil being co-planar. Straight portions of the coils are relatively angularly displaced by 90°, and held between two supporting discs made of insulating material. In this pickup cartridge, however, since the mass of the coil assembly is large, the equivalent mass of the vibration system is large, and particularly the characteristics at the higher frequencies are very poor, whereby the cartridge cannot be considered practical. There is also a suggestion that these coils may be formed by printed circuits, but, with the above-described coil arrangement, reduction to practice is difficult in any case. A pickup cartridge which embodies the above concept has not yet been reduced to practice and placed on the market.

Accordingly, the applicant has previously proposed in U.S. patent application, Ser. No. 775,638, filed Mar. 8, 1977, now abandoned, a novel pickup cartridge of the moving-coil type in which the above-described difficulties have been overcome, and which has been reduced to practice.

In this previously proposed pickup cartridge, a pair of coils are formed by a thin film in a substantially hexagonal, vortex-shaped pattern on a thin glass substrate, this substrate having, for example, a height of 1 mm, a width of 2 mm, and a thickness of 50 microns. This coil plate, which is very lightweight, for example, of the order 0.25 mg, is mounted on the cantilever of the pickup cartridge. In forming the above-described coil patterns, a thin film of metal material of high electrical conductivity, such as nickel, is first formed on both surfaces of the thin insulative substrate by a process such as evaporation deposition in a vacuum. Then parts of the metal film thus deposited are removed by a process such as photo-etching in order to leave the metal film in the spirally wound pattern of the coils. A feature of this pickup cartridge is that the mass of the coil plate is very small, whereby the picking up of signals can be carried out with good characteristics up to and through the higher frequencies.

In the above-described, previously proposed moving-coil type stereo pickup cartridge, a pair of yokes form a magnetic field in a gap therebetween, in which a coil plate is interposed. Each of the yokes has a notch or cutout, the edge parts or facets of which are interconnected at right angles, making angles of plus and minus 45° with respect to a line perpendicular to the record disc. However, contour lines of magnetic flux density in the space between the two facets are not assumed to be exactly parallel with the above-described facets due to the influence of leakage magnetic flux. The contour lines of magnetic flux density are curved, in particular, near the interconnection of the facets and thereby become largely nonparallel with respect to the facets.

In the case where the contour lines of magnetic flux density are not parallel with the yoke facets, which lie at angles of plus and minus 45°, as described above, even when the coil plate undergoes movement, for example, so as to generate output in either the left or right channel, the unexpected output signal is generated in the coil of the other channel, thus giving rise to crosstalk.

The contour lines of magnetic flux density become parallel to the facets with increasing distance from the interconnection of the facets. Therefore, if the facets of the yoke are made long, the coil plate is made relatively large, and the distance between left and right channel coils is made large, the problem of crosstalk may be relieved. However, if this structure is adopted, the reproducing characteristics in the high-frequency range deteriorate, since the mass of the coil plate is large. Consequently, the above structural organization does not have practical application.

SUMMARY OF THE INVENTION

Accordingly, it is a general object of the present invention to provide a novel and useful moving-coil type stereo pickup cartridge in which the above-described problems of the previously proposed pickup cartridge have been solved.

The specific object of the present invention is to provide a moving-coil type stereo pickup cartridge in which the configuration of the facets of the yoke is such that the contour lines of magnetic flux density in a space between the facets are at angles of plus and minus 45° relative to a line perpendicular to the record disc.

Still another object of the invention is to provide a moving-coil type stereo pickup cartridge in which the geometric shape of coil on the coil plate is such that no distortions in the reproduced signal are generated, even if the position of the coil plate with respect to the yoke is somewhat deviated or shifted due to assembling error and the like.

Other objects and further features of the invention will be apparent from the following detailed description of several embodiments of the present invention when read in conjunction with the accompanying drawings.

DETAILED DESCRIPTION

Figure 1:
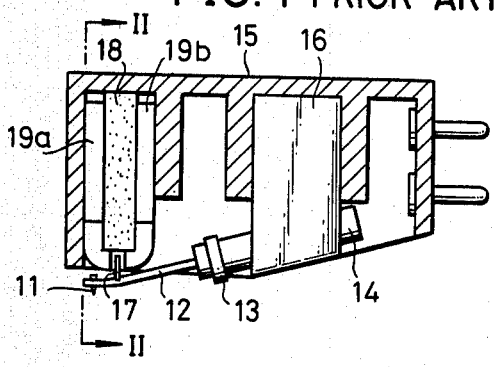
FIG. 1 PRIOR ART
FIG. 1 is a fragmentary vertical sectional side view, showing one embodiment of a moving-coil type stereo pickup cartridge according to the present invention.
Figure 2:
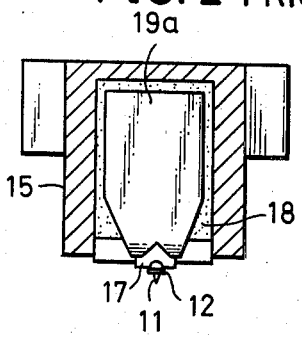
FIG. 2 PRIOR ART
FIG. 2 is a vertical elevation, taken along line II—II in FIG. 1.
Figure 3:
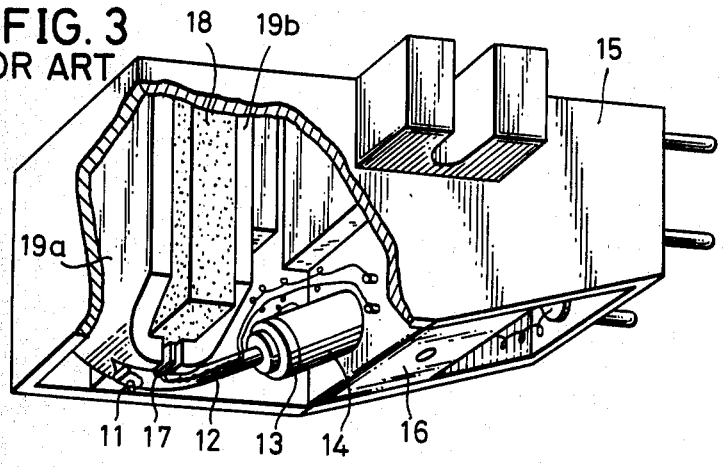
FIG. 3 PRIOR ART
FIG. 3 is a perspective view, with parts cut away, showing the stereo pickup cartridge shown in FIG. 1.

Referring first to FIGS. 1 through 3, a schematic structural diagram of one embodiment of a moving-coil type stereo pickup cartridge, according to the present invention, will now be described. A cantilever 12, having a stylus 11 fixed to its free end, is held at its rear end part by a holder 14 by way of a damper 13 interposed therebetween. The holder 14 is supported by a supporting block 16 fixed to a case 15. In a groove cut in the cantilever 12 at a position in the vicinity of its free end, a coil structure or coil plate 17 is so fixed that its plane is transverse to the axial direction of the cantilever 12.

A permanent magnet 18 of flat-plate shape and a pair of plate-shaped yokes **19*a* and 19*b*, having substantially similar shape and clamping the magnet, are fixed to the front part of the case 15 in the interior thereof. The lower end parts of the yokes 19*a* and 19*b* confront each other with a space gap therebetween under the lower end of the magnet 18. The coil plate 17 is interposed within the gap thus formed between the mutually opposed lower ends of the yokes 19*a* and 19*b***.

Figure 4:
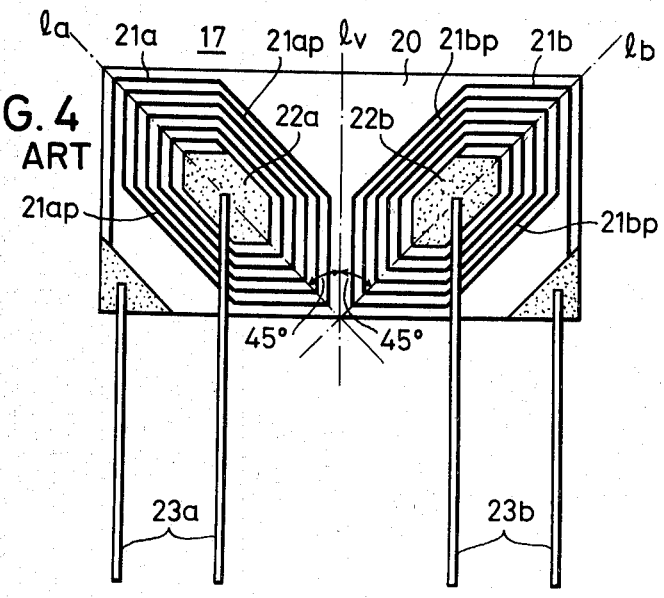
FIG. 4 PRIOR ART
FIG. 4 is an enlarged elevation of the coil plate.

As shown in FIG. 4, the coil plate 17 is a structure comprising a thin glass substrate 20 of, for example, height 1 mm, width 2 mm, and thickness 50 microns, and a pair of coils **21*a* and 21*b* formed as electrically conductive thin films in a spirally wound pattern of approximately hexagonal shape on the glass substrate 20. Another pair of coils may also be formed on the reverse side of the substrate 20 and so connected to the coils 21*a* and 21*b* on the front side of the substrate that their numbers of winding turns are additive. At the ends of the coils 21*a* and 21*b* there are formed electrical conductor parts 22*a* and 22*b* of width greater than the width of the thin film coil wires. Two lead wires 23*a* and two lead wires 23*b* are connected to and led out from these electrical conductor parts 22*a* and 22*b*, respectively. The weight of the coil plate 17** is of very low value, e.g. of the order of 0.25 mg. Accordingly, this pickup cartridge of the invention is superior to the conventional cartridge in accomplishing good signal pickup and reproduction over a wide band up to a high-frequency range with flat characteristics.

Lines la and lb extending in the longitudinal direction of the coils **21*a* and 21*b* have angles of inclination of plus and minus 45° with respect to a direction lv perpendicular to the record disc. The coils 21*a* and 21*b* have parts 21*ap* and 21*bp*** which are parallel with each other.

As shown in FIG. **5*a*, the yoke 19*a* (19*b*) is formed with a reverse V-shaped cutout or notch 25 in its lower end, this notch having end-edge parts or facets 25*a* and 25*b*** which are substantially perpendicular to the lines la and lb, respectively.

Even though the coil plate 17 is fixed to the cantilever 12 with an assembling error such that the center line lc1 of the coil plate 17 is misaligned with the center line lc2 of the notch 25 of the yoke **19*a*, facets 25*a* and 25*b* of the notch 25 formed in the yoke 19*a* still confront parallel parts 21*ap* and 21*bp* of the coils 21*a* and 21*b***, respectively.

When the coil plate 17 vibrates in the directions of lines la and lb (i.e., at angles of plus and minus 45°) as the stylus 11 traces the groove of the sound track on the record disc, the parallel parts 21*ap* and 21*bp* do not cut or intersect the magnetic flux established in the space between the yokes 19*a* and 19*b*. Otherwise, signals induced on the parallel parts 21*ap* and 21*bp* cancel each other. Accordingly, the parallel parts 21*ap* and 21*bp* do not induce a signal. The signal is induced only by the nonparallel parts of the coils 21*a* and 21*b*, which confront the yoke pieces 19*a* and 19*b*, rather than by the parallel parts 21*ap* and 21*bp*.

If it is assumed that the coils 21*a* and 21*b* have no parallel parts 21*ap* and 21*bp*, the outputs of the coils 21*a* and 21*b* vary as the area of the nonparallel parts of the coils 21*a* and 21*b* confronting the yokes 19*a* and 19*b* varies, due to the above-described assembling error. This gives rise to unbalancing of the left and right stereo reproducing signals, and generation of distortion in the reproducing signal.

However, since the coil of the pickup cartridge according to the present invention has the parallel parts 21*ap* and 21*bp*, as described above, the presence of the assembling error does not generate the above-described problems.

The nonparallel parts of the coils 21*a* and 21*b*, which do not confront the yokes 19*a* and 19*b*, are so formed that the lines la and lb thereof extend in a direction substantially perpendicular to the facets 25*a* and 25*b*, respectively, of the yokes, i.e., in a direction away from the facets. This arrangement results in the least influence of the leakage magnetic flux present at the notch 25.

Figure 5A:
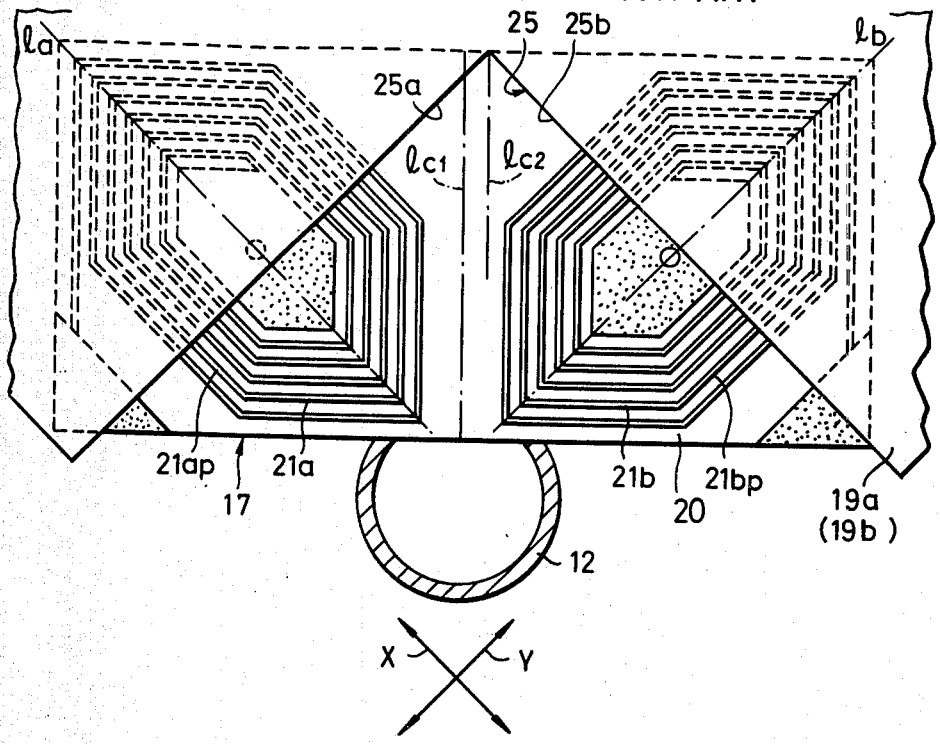
FIG. 5A PRIOR ART
FIG. 5A is a front view of the yoke and the coil plate which illustrates the situation where there exists an error in the relative fitting positions of the coil plate and yoke piece.
Figure 5B:
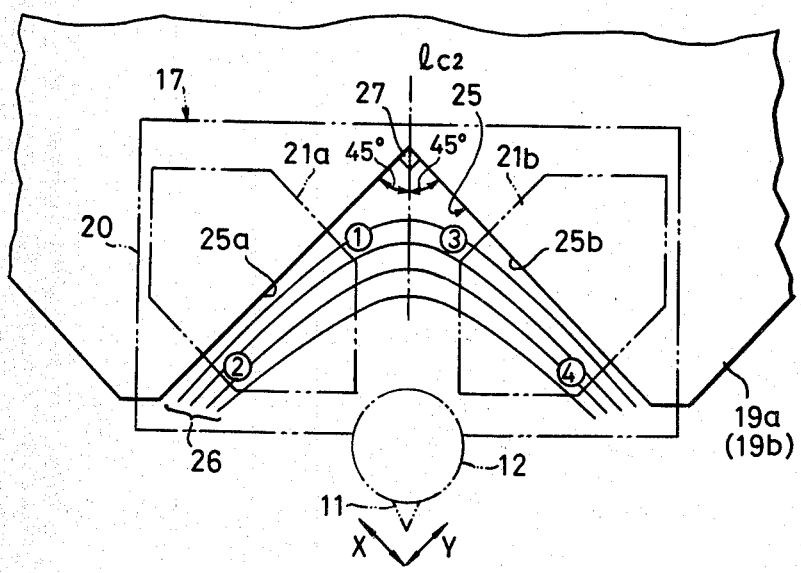
FIG. 5B is a front view of the yoke and the coil plate which illustrates the contour lines of magnetic flux density in the previously proposed moving-coil type stereo pickup cartridge.

For the case where the notch 25 of the yoke 19*a* is formed in a manner such that the facets 25*a* and 25*b* thereof are at angles of plus and minus 45° relative to the center line lc2, the contour lines of magnetic flux density obtained by connecting points of equal density of leakage magnetic flux generated in the space within the notch 25 are indicated by curves 26 in FIG. 5B. Since the leakage magnetic fluxes from the facets 25*a* and 25*b* of the yoke piece are added together, the contour lines 26 of magnetic flux density do not become parallel with the facets 25*a* and 25*b*, as indicated in the same figure. As the contour lines diverge from the interconnection 27 (i.e., a root of the point of the reverse V-shaped notch) of the facets 25*a* and 25*b*, the contour lines of magnetic flux density approach parallelism with the confronting facets. However, the degree of addition of the leakage magnetic fluxes from respective facets becomes large as the interconnection 27 is approached whereby the curved contour lines 26 of magnetic flux density are nonparallel with the facets 25*a* and 25*b*.

In this case, when the coil plate 17 is displaced due to vibration in the direction indicated by arrow Y, for instance, as the stylus 11 traces the groove of the sound track on the record disc, the electromotive force generated from the coil part near position ① of the coils 21*a* becomes larger than that generated from the coil part near position ②. Consequently, although the coil 21*a* should not generate any output when subjected to vibration in the direction indicated by arrow Y, the coil 21*a* generates undesired signals as output. The undesired output becomes a crosstalk component. When the coil plate 17 is displaced due to vibration in the direction indicated by arrow X, a crosstalk component arises, in the same manner, at the output of the coil 21*b*.

The pickup cartridge of the present invention is constructed with a geometrical shape of the notch 25 in the yoke 19*a* (19*b*) such that, as described hereinafter, it prevents the generation of crosstalk.

Figure 6:
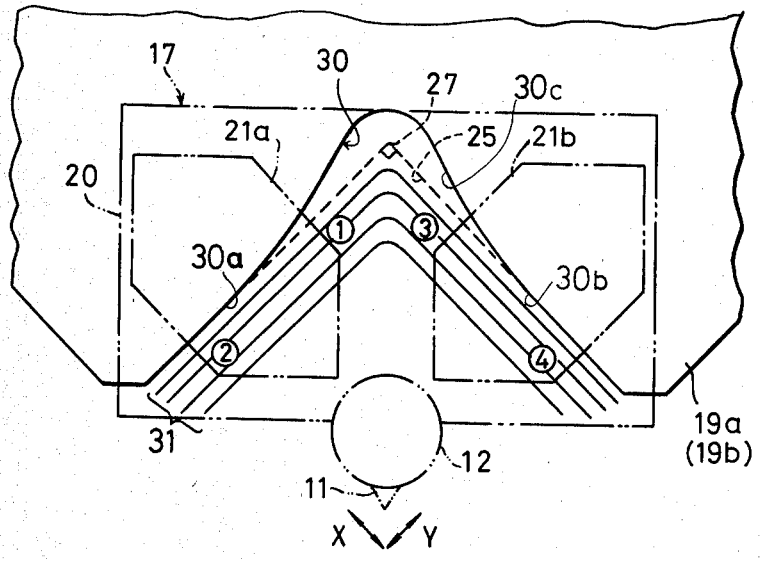
FIG. 6 illustrates diagrammatically the essential parts of a first embodiment of a moving-coil type stereo pickup cartridge according to the present invention.

The shape of a first embodiment of a notch in the yoke 19*a* (19*b*) is shown in FIG. 6. The notch 30 has a configuration wherein a curved recess is formed further up with respect to the notch 25, in the vicinity of the point 27. Thus, the notch 30 consists of the edge parts 30*a* and 30*b* which are substantially the same as the coincident portions of facets 25*a* and 25*b* of the above-described notch 25, and an edge part 30*c* comprising a curved recess.

Due to the existence of this recessed edge part 30*c*, the leakage magnetic flux near the point 27 is less than when no recessed edge part 30*c* is present, and the contour lines 31 of magnetic flux density become linear up to near the point 27. Thus, the contour lines of leakage magnetic flux density in the space within the notch 30, and opposing the coils 21*a* and 21*b*, make angles of substantially plus or minus 45° with respect to a line perpendicular to the record disc, whereby the electromotive force generated at respective positions ① through ④ is constant. Therefore, when the coil plate 17 undergoes displacement due to vibration in the X and Y directions, the electromotive forces at positions ① and ② of the coil 21*a* are cancelled, and no crosstalk is thereby generated in the coil 21*a*. The result is the same in the coil 21*b*, so that no crosstalk output is generated in the coil 21*b*.

Figure 7:
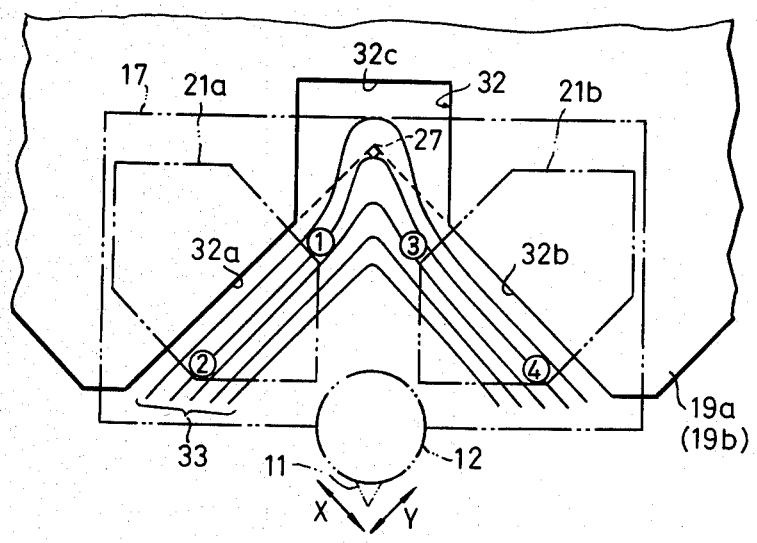
FIG. 7 illustrates the essential parts of a second embodiment.

FIG. 7 shows a second embodiment of the notch shape. The notch 32 has facets 32*a* and 32*b*, extending in plus and minus 45° directions, and an edge part 32*c* comprising a rectilinear recess formed upwards near the point 27. In accordance with the present embodiment, the existence of the rectilinear recess edge part 32*c* causes the contour lines 33 of magnetic flux density in the vicinity of the point 27 to be so shaped as to enter into the above-described rectilinear recess or square-formed cutout. The contour lines of magnetic flux density within the space of the notch 32 opposing the coils 21*a* and 21*b* thereby have a plus or minus 45° direction. Accordingly, the same effect as that achieved in the case of the above-described first embodiment can be obtained.

Figure 8:
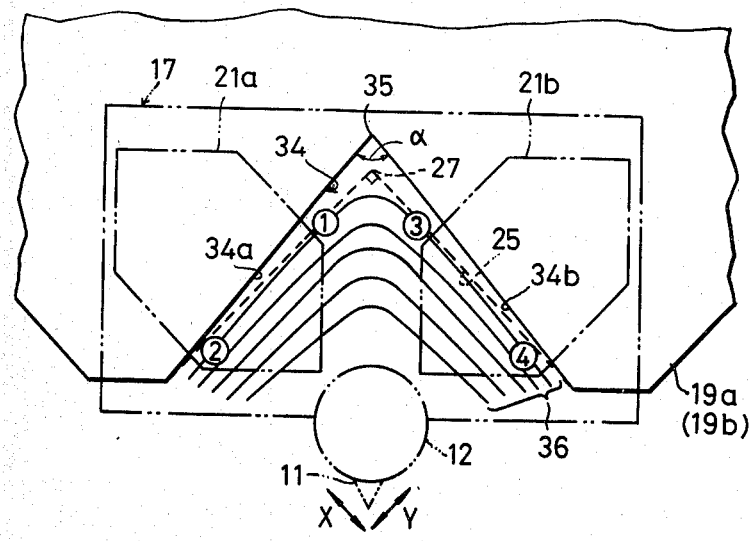
FIG. 8 illustrates the essential parts of a third embodiment.

A third embodiment of the shape of the notch formed in the yoke is indicated in FIG. 8. A notch 34 has facets 34*a* and 34*b* which are interconnected at a point 35 shifted above the point 27. The angle $\alpha$ at the point 35, formed by facets 34*a* and 34*b*, is less than 90°, i.e., $\alpha < 90°$. In the present embodiment, the angle $\alpha$ is set equal to 80°, for instance.

The value of magnetic flux density around the point 27 decreases also in the present embodiment, and the contour lines 36 of magnetic flux density extend in the directions of substantially plus or minus 45°.

According to the present embodiment, the notch 34 is formed with ease.

Figure 9:
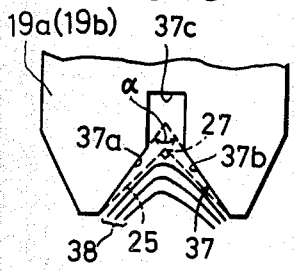
FIG. 9 illustrates the essential parts of a fourth embodiment.

A fourth embodiment of the shape of the notch formed in the yoke is indicated in FIG. 9. The notch 37 has a shape that substantially combines or superimposes the notch 34 in FIG. 8 and the rectilinear recess or square-edged part 32*c* in FIG. 7. That is, the notch 37 has facets 37*a* and 37*b*, the planes of which would intersect at a point shifted or deviated above the point 27 and at an angle $\alpha$ ($<90°$), and an edge part or rectilinear recess 37*c* above the point 27.

The leakage magnetic flux near the point 27 decreases, and the contour lines 38 of magnetic flux density extend in the direction of substantially plus or minus 45°, whereby the same effect as that in the above-described first embodiment can be obtained.

The shape of the notch in the yoke is not limited to those in the above-described embodiments, but need only be one which is sufficiently adapted so as to decrease the leakage magnetic flux near the point 27. In order to accomplish this, it is sufficient that a portion of each of the facets 25*a* and 25*b* be recessed upwards at least around the point 27 of the notch 25.

Figure 10:
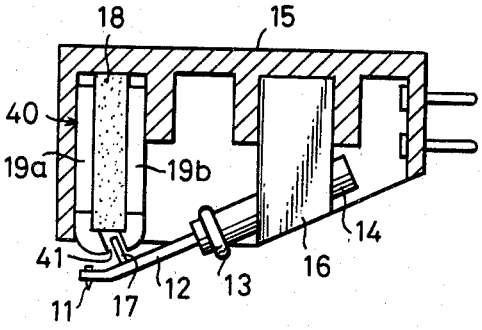
FIG. 10 is a side view, showing a modification of a moving-coil type stereo pickup cartridge, according to the present invention.

FIG. 10 shows a modification of the pickup cartridge according to the present invention. In the same figure, the parts which are the same as corresponding parts in FIG. 1 are designated by like reference numerals, and a detailed description of such parts will be omitted.

A magnetic circuit 40 comprises a flat permanent magnet 18 made of magnetic material such as a rare earth element or ferrite, having higher energy product, and pair of yokes 19*a* and 19*b* which have substantially the same shape and are fixed to clamp the magnet 18 therebetween. A gap 41 is formed with an inclination in conformity with extending direction or angle of tilt of the coil plate 17, and the magnetic circuit 40 is thereby incorporated into the casing 15 in its vertical state.

In the magnetic circuit indicated in FIG. 1 and FIG. 10, the yoke surfaces that form the gap are flat. However, in order to narrow the gap width, it is desirable theoretically to curve the gap-forming surface (a portion of spherical surface) in conformity with the locus of the coil plate as it moves during playing of the record disc. This arrangement causes the magnetic flux density within the gap to become sufficiently high, thereby improving the output voltage characteristics of the pickup cartridge.

However, in actual practice it is difficult to make the gap-forming surfaces curved. Therefore, the following embodiment solves this problem by selecting a mounting angle of the coil plate to the cantilever and the disposition of the coil plate within the gap.

Next, a description is given of the mounting of the coil plate onto the cantilever in the pickup cartridge in FIG. 1, with reference to FIG. 11 through FIG. 17.

Figure 11:
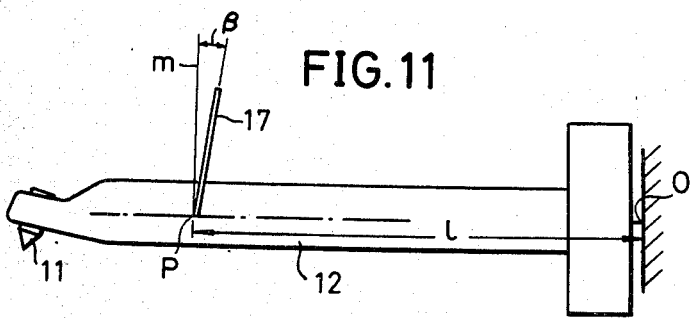
FIG. 11 illustrates the assembled structure of the coil plate and the cantilever, for a moving-coil type stereo pickup cartridge according to the present invention.

Referring to FIG. 11, the coil plate 17 is fixed to the cantilever 12 at a position P separated by a distance l from the vibration fulcrum O and is inclined toward the vibration fulcrum at an angle $\beta$ relative to a line m, which is perpendicular to the cantilever axis indicated by the one-dot chain line. A circular arc n of radius l about the vibration fulcrum O and another circular arc p of radius h, which equals the height of the coil plate 17, about the point P intersect at point Q in FIG. 13. The coil plate 17 is mounted with an inclination such that the top thereof coincides with the point Q.

Accordingly, the difference between the maximum distance l and the minumum distance l1 of the coil plate 17 from the point O becomes a minimum, and the extended plane direction of the coil plate 17 coincides with the vibrating direction of the coil plate 17 at the center point S thereof.

An inclination angle $\beta$ of the coil plate 17 with respect to the perpendicular line n equals $<$SOP, and is thereby represented by $\sin^{-1} h/2l$.

Figure 12:
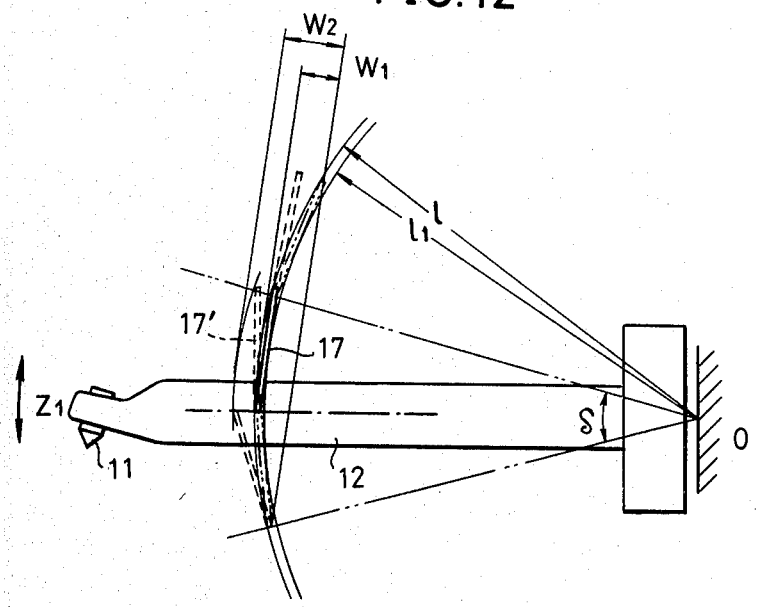
FIG. 12 is a diagram for description of operation of the assembly indicated in FIG. 11, at the time when the record is played.
Figure 13:
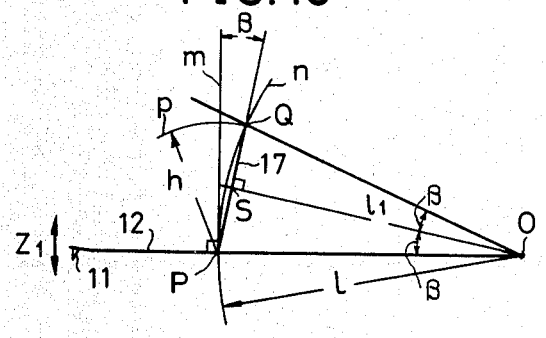
FIG. 13 is a schematic representation, showing the organization of the assembly in FIG. 11.

When the record disc is being played, the cantilever 12 undergoes revolving displacement in the direction indicated by arrow Z1 over an angle $\delta$ and the coil plate 17 is thereby moved as indicated by two-dot chain lines in FIG. 12. Accordingly, the gap width of the magnetic circuit reaches its minimum value w1. On the other hand, in the case where the coil plate 17′ is vertically fixed to the cantilever 12 as indicated by broken lines in the same figure, the magnetic circuit should be provided with a gap width w2 ($>$w1).

Figure 14:
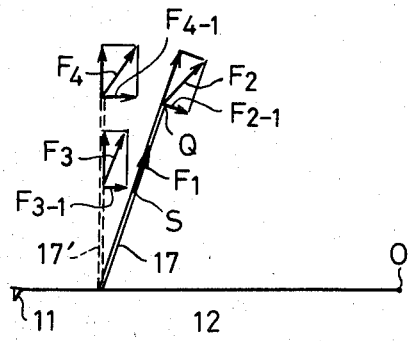
FIG. 14 shows the relationship of the forces acting on the coil plate when the record is played.

Moreover, when the coil plate 17 is moving, the coil plate 17 is acted upon by a force F1 at a center point S thereof and by another force F2 at its top Q, as shown in FIG. 14. The force F1 acts in the direction in which the surface of the coil plate 17 extends, whereby the component of the force F1 perpendicular to the surface of the coil plate 17 is zero. The component F2-1 of the force F2 is perpendicular to the plane of the coil plate. This component F2-1 induces undesired vibration of the coil plate 17′.

As is apparent from FIG. 14, the force acting on the inclined coil plate 17 in the direction perpendicular to its surface, during record playing operation, becomes smaller than that in the case of the vertical coil plate 17′. The coil plate 17, therefore, does not give rise to any vibration in the direction perpendicular to its surface.

Therefore, the structural organization of the coil plate 17 mounted at an inclination angle $\beta$ not only enhances the output voltage of the pickup cartridge, but also prevents any deterioration in characteristics due to undesired vibration of the coil plate 17.

Figure 15:
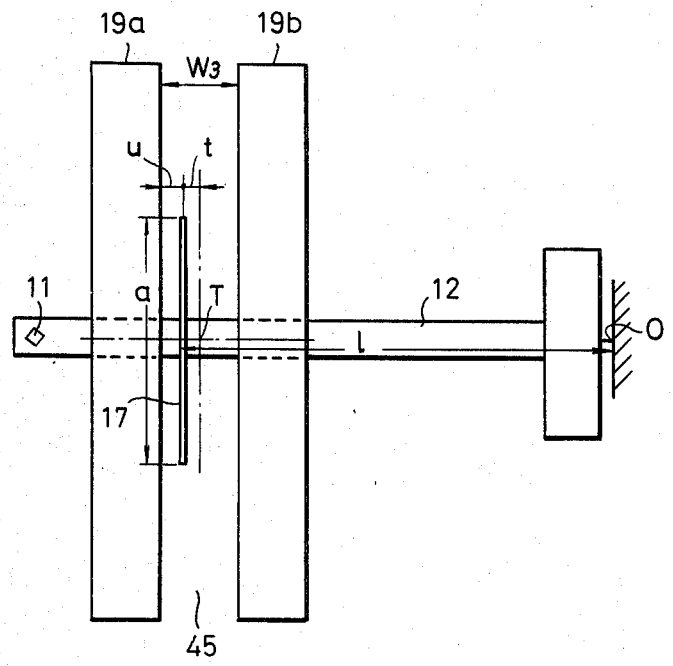
FIG. 15 and FIG. 16 are a plan view and a side view, respectively, showing the positional relationship between the coil plate and the magnetic circuit, in the pickup cartridge indicated in FIG. 1.
Figure 16:
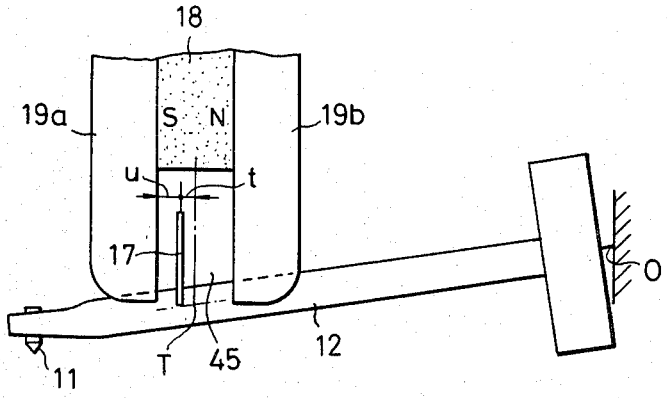

In the embodiment indicated in FIG. 15 and FIG. 16, the coil plate 17 is not positioned at the center plane position T of the gap 45 between the confronting surfaces of the yokes 19*a* and 19*b* but rather it is shifted or deviated by a distance t toward the free end of the cantilever 12.

Figure 17:
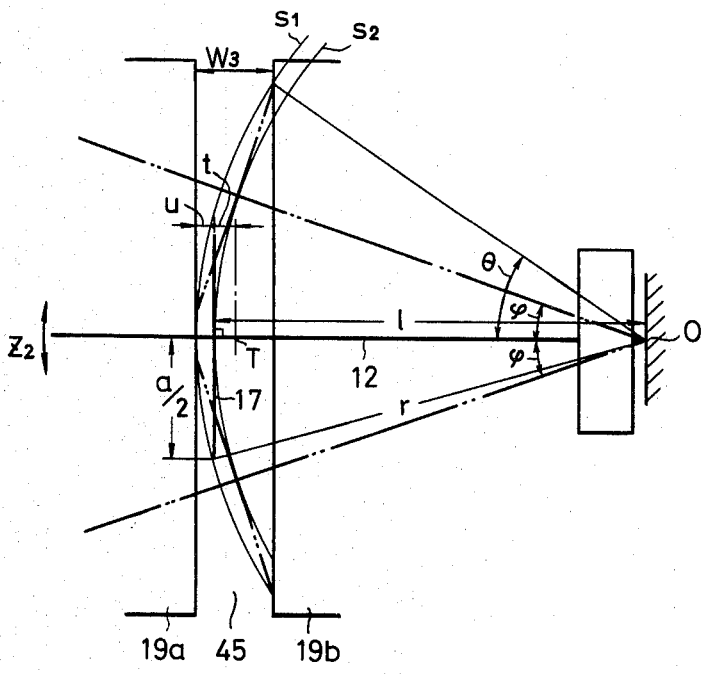
FIG. 17 illustrates the operation of the coil plate within a gap as in FIG. 15.

Referring to FIG. 17, when the cantilever 12 undergoes revolving displacement in the horizontal plane in the direction indicated by arrow Z2, the locus of the moving coil plate 17 is within an area determined by circular arcs s1 and s2. When observing the locus carefully, it can be seen that the displacement of the edge parts of the coil plate 17 toward the free end of the cantilever is small, and the displacement in the opposite direction, that is, toward the cantilever, is large. The gap space is determined in conformity with the locus of the moving coil plate 17, while the coil plate 17 is shifted or deviated from the center of the gap towards the stylus 11. In connection with it, the gap width w3 of the magnetic circuit becomes narrower in comparison with the gap in which the coil plate is fixed at a center position thereof, and the output voltage of the pickup cartridge thereby increases.

Here, the shift or deviation t from the center plane position T of the gap is represented by $$t = l - \tfrac{1}{2}(r + r\cos\theta),$$

where r is the length between the vibration fulcrum O and the edge of the coil plate 17, and $\theta$ is the angle between a line passing through the point O and the outer edge of the coil plate 17 when the cantilever 12 has revolved by an angle $\phi$ and the axis of the cantilever 12 is at its neutral position.

A distance u between the face of the front yoke piece and the coil plate 17 is represented by $$u = r - l = \sqrt{l^2 + (a/2)^2} - l,$$

where a is the width of the coil plate 17.

Figure 18:
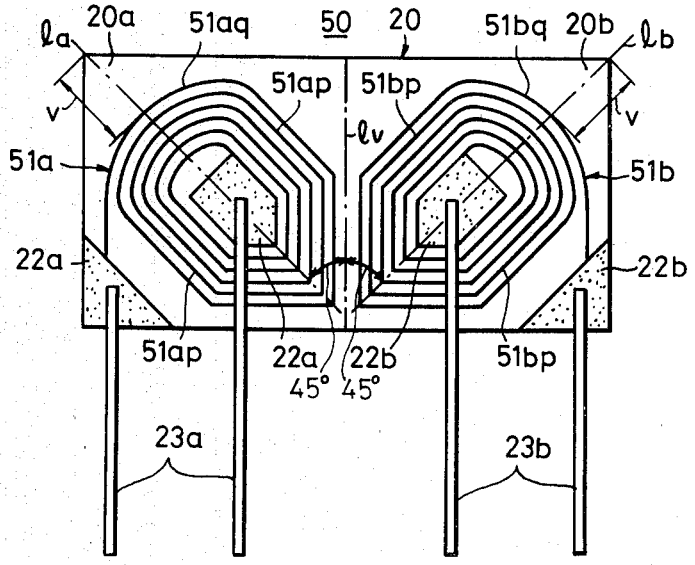
FIG. 18 is a plan view, showing another embodiment of a coil plate which can be applied to the pickup cartridge of the present invention.

The coil plate 50 indicated in FIG. 18 may be incorporated within the pickup cartridge indicated in FIG. 1. In FIG. 18, parts which are substantially the same as corresponding parts in FIG. 4 are designated by like reference numerals. Detailed description of such parts will not be repeated.

The pattern 51*aq* of the coil 51*a* has a circular arc configuration and is disposed at the upper left position so that it connects parallel parts 51*ap* on both sides of the line la. Similarly, the pattern 51*bq* of the coil 31*b* has a circular arc configuration and is disposed at the upper right position so that it connects parallel parts 51*bp* on both sides of the line lb. In this arrangement, the above-described patterns 51*aq* and 51*bq* are formed at positions relatively separated or removed from the upper left and right corners 20*a* and 20*b* of the thin glass substrate 20 and toward the center of the coils 51*a* and 51*b*. That is, the distance v becomes relatively large. Consequently, even if the glass substrate 20 is broken off at the upper left and right corners 20*a* and 20*b* thereof, the coils 51*a* and 51*b* are not damaged. The yield rate in manufacturing the coil plate is improved. Moreover, the present invention is not limited to the above-described embodiments, but it is sufficient that the shape of the edge part or facet defining a substantially reverse V-shaped cutout or notch formed in a pair of yokes, which constitute magnetic field-forming means in cooperation with a single permanent magnet, is such that the contour lines of density of the leakage magnetic flux within a space of the notch confronting the coils extend in the plus or minus 45° direction with respect to a line perpendicular to the record disc.

Further, this invention is not limited to these embodiments but various variations and modifications may be made without departing from the scope of the invention.

What is claimed is:

1. A moving-coil type stereo pickup cartridge, comprising, a vibration system including a stylus for tracing a sound groove of a record disc; at least one coil plate provided in said vibration system to vibrate in response to vibrations of said stylus; and means for forming a magnetic field for said coil plate, said coil plate comprising a thin insulative substrate and a pair of left and right coils substantially symmetric with respect to a center line of said coil plate, said coils being formed by an electrically conductive thin film in a spirally wound pattern on at least one surface of said substrate, and said magnetic field forming means comprising a permanent magnet piece and a pair of yoke pieces clamping said permanent magnet piece, said pair of yoke pieces having surfaces at the ends thereof for defining a gap therebetween in which said coil plate is interposed and a cutout recessed in each of said ends of said yoke pieces with a configuration having a substantially inverted V-shape, each of said ends of said yoke pieces having an edge for defining said cutout, the shape of said edge being configured and dimensioned to form the contour lines of magnetic flux density of leakage magnetic flux within the space defined by said cutout and passing through said coils to extend in a substantially linear direction and substantially parallel to each other.

2. A stereo pickup cartridge as claimed in claim 1 in which said edge of each yoke piece comprises first and second edge portions extending in 45°—45° directions with respect to said center line, and a third edge portion connecting said first and second edge portions, said third edge portion being above hypothetical extension lines of said first and second edge portions.

3. A stereo pickup cartridge as claimed in claim 2 in which said third edge portion has a curved configuration.

4. A stereo pickup cartridge as claimed in claim 2 in which said third edge portion has a rectangular configuration.

5. A stereo pickup cartridge as claimed in claim 1 in which the edge of each yoke piece comprises a pair of edge portions having an angle $\alpha$ therebetween, said angle $\alpha$ being less than 90°.

6. A stereo pickup cartridge as claimed in claim 5 in which said angle $\alpha$ is selectively determined at substantially 80°.

7. A stereo pickup cartridge as claimed in claim 1 in which said vibration system includes a cantilever provided at its free end with said stylus, and said coil plate is fixed to said cantilever in an inclined state from a plane perpendicular to a longitudinal direction of said cantilever by an inclination angle $\beta$.

8. A stereo pickup cartridge as claimed in claim 1 in which said coil plate is disposed within a gap between said pair of yoke pieces at a position deviated from a center plane between confronting surfaces of said yokes by a predetermined distance toward said stylus said center line being parallel to said confronting surfaces of said yoke.

* * * * *